US010580261B2

(12) United States Patent
de Mello Costa

(10) Patent No.: US 10,580,261 B2
(45) Date of Patent: Mar. 3, 2020

(54) GAMING MACHINE, SYSTEM, AND METHOD FOR A LATIN BINGO GAME

(71) Applicant: AGS, LLC, Las Vegas, NV (US)

(72) Inventor: Marcus Fortunato de Mello Costa, Las Vegas, NV (US)

(73) Assignee: AGS LLC, Las Vegas, NV (US)

( * ) Notice: Subject to any disclaimer, the term of this patent is extended or adjusted under 35 U.S.C. 154(b) by 65 days.

(21) Appl. No.: 15/272,281

(22) Filed: Sep. 21, 2016

(65) Prior Publication Data

US 2018/0082515 A1 Mar. 22, 2018

(51) Int. Cl.
*G07F 17/32* (2006.01)

(52) U.S. Cl.
CPC ..... *G07F 17/329* (2013.01); *G07F 17/3209* (2013.01); *G07F 17/3211* (2013.01); *G07F 17/3244* (2013.01)

(58) Field of Classification Search
CPC ..... G07F 17/329; G07F 17/3211; G07F 17/3244; G07F 17/3209
See application file for complete search history.

(56) References Cited

U.S. PATENT DOCUMENTS 5,967,895 A 10/1999 Kellen
6,244,958 B1 * 6/2001 Acres ..... G07F 17/32 463/16
2006/0089191 A1 * 4/2006 Singer ..... G07F 17/32 463/20
2008/0032765 A1 2/2008 Frain
2012/0077562 A1 3/2012 Herrmann et al.
2013/0316784 A1 * 11/2013 Coleman ..... G07F 17/32 463/19
2013/0324211 A1 * 12/2013 Huynh ..... G07F 17/3286 463/19
2014/0073402 A1 3/2014 Colvin et al.
2014/0274280 A1 * 9/2014 Macbeth ..... G07F 17/329 463/19

OTHER PUBLICATIONS

International Search Report and Written Opinion for PCT/US/17/051890 dated Nov. 30, 2017, 8 pages.
Written Opinion of the International Searching Authority for PCT/US/17/051890 dated Nov. 30, 2017, 5 pages.
Wikipedia, Video Bingo, https://en.wikipedia.org/w/index.php?title=Video_bingo&printable=yes, Mar. 25, 2017, 2 pages.

* cited by examiner

*Primary Examiner* — Kevin Y Kim
(74) *Attorney, Agent, or Firm* — Weide & Miller, Ltd.

(57) ABSTRACT

A gaming machine and a gaming method for playing a Latin bingo includes displaying one or more Latin bingo cards where each of the one or more Latin bingo cards comprising at least one free space, drawing bingo balls and daubing corresponding numbers on the one or more Latin bingo cards, comparing the one or more Latin bingo cards to predetermined matching winning outcomes, and awarding an award to said player when the one or more Latin bingo cards matches the predetermined matching winning outcomes.

13 Claims, 8 Drawing Sheets

SINGLE CARD 110

| | | | | |
|---|---|---|---|---|
| 9 | 23 | 47 | 67 | 79 |
| 11 | 31 | 54 | 69 | 80 |
| 20 | 46 | 55 | 72 | 86 |

SERIES 120

| | | | | |
|---|---|---|---|---|
| 9 | 23 | 47 | 67 | 79 |
| 11 | 31 | 54 | 69 | 80 |
| 20 | 46 | 55 | 72 | 86 |

| | | | | |
|---|---|---|---|---|
| 2 | 27 | 40 | 63 | 78 |
| 10 | 32 | 43 | 68 | 87 |
| 17 | 38 | 52 | 73 | 90 |

| | | | | |
|---|---|---|---|---|
| 3 | 28 | 39 | 51 | 76 |
| 16 | 29 | 42 | 60 | 81 |
| 18 | 33 | 49 | 70 | 83 |

| | | | | |
|---|---|---|---|---|
| 4 | 15 | 34 | 50 | 62 |
| 8 | 21 | 36 | 56 | 71 |
| 14 | 22 | 48 | 61 | 85 |

| | | | | |
|---|---|---|---|---|
| 1 | 19 | 44 | 57 | 77 |
| 6 | 25 | 45 | 64 | 84 |
| 12 | 35 | 55 | 75 | 88 |

| | | | | |
|---|---|---|---|---|
| 5 | 34 | 37 | 59 | 74 |
| 7 | 26 | 41 | 65 | 82 |
| 13 | 30 | 58 | 66 | 89 |

FIG. 1

SERIES OF 10 CARDS - 6 FREE SPACES

| | | | | |
|---|---|---|---|---|
| 1 | | 31 | | 75 |
| | 21 | 46 | 65 | |
| 12 | | 56 | | 90 |

| | | | | |
|---|---|---|---|---|
| 2 | | 32 | | 72 |
| | 25 | 41 | 61 | |
| 11 | | 57 | | 82 |

| | | | | |
|---|---|---|---|---|
| 6 | | 36 | | 73 |
| | 26 | 50 | 67 | |
| 14 | | 58 | | 88 |

| | | | | |
|---|---|---|---|---|
| 3 | | 39 | | 77 |
| | 29 | 42 | 69 | |
| 19 | | 51 | | 89 |

| | | | | |
|---|---|---|---|---|
| 4 | | 40 | | 75 |
| | 24 | 45 | 64 | |
| 13 | | 55 | | 87 |

| | | | | |
|---|---|---|---|---|
| 9 | | 33 | | 80 |
| | 22 | 44 | 62 | |
| 17 | | 60 | | 81 |

| | | | | |
|---|---|---|---|---|
| 15 | | 35 | | 78 |
| | 27 | 47 | 68 | |
| 20 | | 54 | | 85 |

| | | | | |
|---|---|---|---|---|
| 8 | | 38 | | 71 |
| | 30 | 43 | 70 | |
| 10 | | 52 | | 83 |

| | | | | |
|---|---|---|---|---|
| 5 | | 34 | | 74 |
| | 23 | 48 | 63 | |
| 16 | | 59 | | 86 |

| | | | | |
|---|---|---|---|---|
| 7 | | 37 | | 79 |
| | 28 | 49 | 66 | |
| 18 | | 53 | | 84 |

FIG. 6

GAMING MACHINE, SYSTEM, AND METHOD FOR A LATIN BINGO GAME

FIELD

The disclosed embodiments relate to methods of presenting and playing games and gaming machines configured to present games. More specifically, the disclosed embodiments relate to Bingo games, such as a Latin Bingo Game, and more particularly to a Latin Video Bingo Game played on Electronic Video Machines (EGM).

BACKGROUND

Many styles of gaming machines and games are known, including casual (or non-wagering) gaming and wager-based gaming. A Latin Video Bingo Game popularly known as an Electronic Video Bingo Game is a game of chance where players purchase bingo cards of multiple monetary values, and are awarded prizes based on the achievement of predetermined patterns.

Latin Video Bingo is played on an electronic gaming machine ("EGM") on which a player plays a game of bingo where a player selects a number of cards to play and a value of cards to play. A random number generator generates random numbers displayed as bingo balls determining the "draw" of the game from a pool of numbers between one and ninety. Once the first draw or base game is drawn, a subsequent draw is offered to the player where each ball is individually priced and optioned to play by the player.

In the standard Latin Bingo Game played manually on paper as shown in FIG. 1, Latin Bingo Cards or 90 Ball Bingo Cards 110, as such are traditionally known, display a matrix of three rows and five columns, containing fifteen numbers each. A "Series" 120 of cards is known as six cards with no repeated number containing all ninety possible numbers in the draw, having any and all numbers drawn be a hit or marked in one of the six cards purchased (but where less than all 90 numbers are drawn, such that the number of balls which are drawn are all marked and the pattern of matches to the subset of drawn balls on the cards defines the game outcome to the player).

In the Latin Video Bingo format played on Electronic Video Machines (EGM), the game software is programmed to replicate the traditional game of Latin Bingo or 90 Ball Bingo by offering the player the ability to purchase one or more cards 110 without repeated numbers, and drawing the game balls based on the pool of numbers displayed on the cards available, thus replicating the same game experience to the player that every ball is a hit or mark on a card.

Players are awarded prizes based on the achievement of predetermined prize patterns displayed on the game screen as the example in FIG. 2. The achievement of prize patterns based on the random numbers displayed as bingo balls determining the "draw" of the game from a predetermined pool of numbers (where the draw draws a subset of all of the possible numbers, such as 30 of 90 numbers or the like) establishes the game outcome.

As in the traditional Latin Bingo Game played on paper, versions played electronically on Electronic Video Machines (EGM), replicate the simplicity and traditional game of bingo. Contrary to games known as "Slot Machines," Video Bingo in its essence is a simple game played at fast speeds. One aspect affecting the popularity of the game is RTP %—Return to the player percentages based on the predetermined values on the prizes achieved of the predetermined prize patterns. In particular, one disadvantage to some Latin Bingo games is that the RTP is too low, making the game undesirable to the player.

Thus, the disclosed embodiments relate to game features and enhancements that create a differential game experience to the player resulting in a more exciting and enjoyable game of Latin Video Bingo.

SUMMARY

Embodiments of the invention comprise methods of playing and presenting games, and gaming machines, systems and other devices to present a new Latin Bingo type game functionality. One embodiment of the invention comprises a gaming machine or device which comprises a monetary funds accepting mechanism for accepting monetary funds in creating a player credit balance, at least one display device, at least one player input device, a memory device, a controller, and machine-readable code stored in the memory device and executable by the controller.

The machine-readable code is configured to cause the controller to cause the at least one display device to display one or more Latin bingo cards where each of the one or more Latin Bingo cards comprising at least one free or wild space, draw bingo balls/numbers and daub corresponding numbers on the one or more Latin bingo cards, compare the one or more Latin bingo cards to predetermined matching winning outcomes, and award an award to said player when the one or more Latin bingo cards matches the predetermined matching winning outcomes.

In further embodiments, additional wild spaces are added to the one or more Latin Bingo cards based on the drawn bingo balls. For example, the additional wild spaces may be a column of the one or more Latin Bingo cards where the column corresponds to a number in a top row of the one or more Latin Bingo cards that corresponds to a first three or a last three of the drawn bingo balls.

In some embodiments, each of the one or more Latin Bingo cards comprises a three row by five column bingo card with six free spaces. The six free spaces may be distributed with two of the six free spaces in each row. In one example, the two free spaces in a first row and a third row are placed in a second and a fourth column, and the two free spaces in a second row are placed in a first and a fifth column.

In some embodiments, the one or more Latin Bingo cards comprises a series of cards. The series of cards may comprise ten Latin Bingo cards with the six free spaces. The display of the gaming machine may be customized for at least one of a background screen color, dauber color, and game speed.

Further objects, features, and advantages of the present invention over the prior art will become apparent from the detailed description of the drawings which follows, when considered with the attached figures.

BRIEF DESCRIPTION OF THE DRAWINGS

FIG. 1 shows an exemplary Latin bingo card and an exemplary series of Latin bingo cards.

FIG. 6 is a series of Latin bingo cards with free spaces, according to one exemplary embodiment.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise methods of playing and presenting games, gaming machines and gaming systems. In a preferred embodiment, the methods of game play and presentation are implemented via a gaming machine or gaming system. Such a gaming machine may have various configurations.

The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

Figure 3:
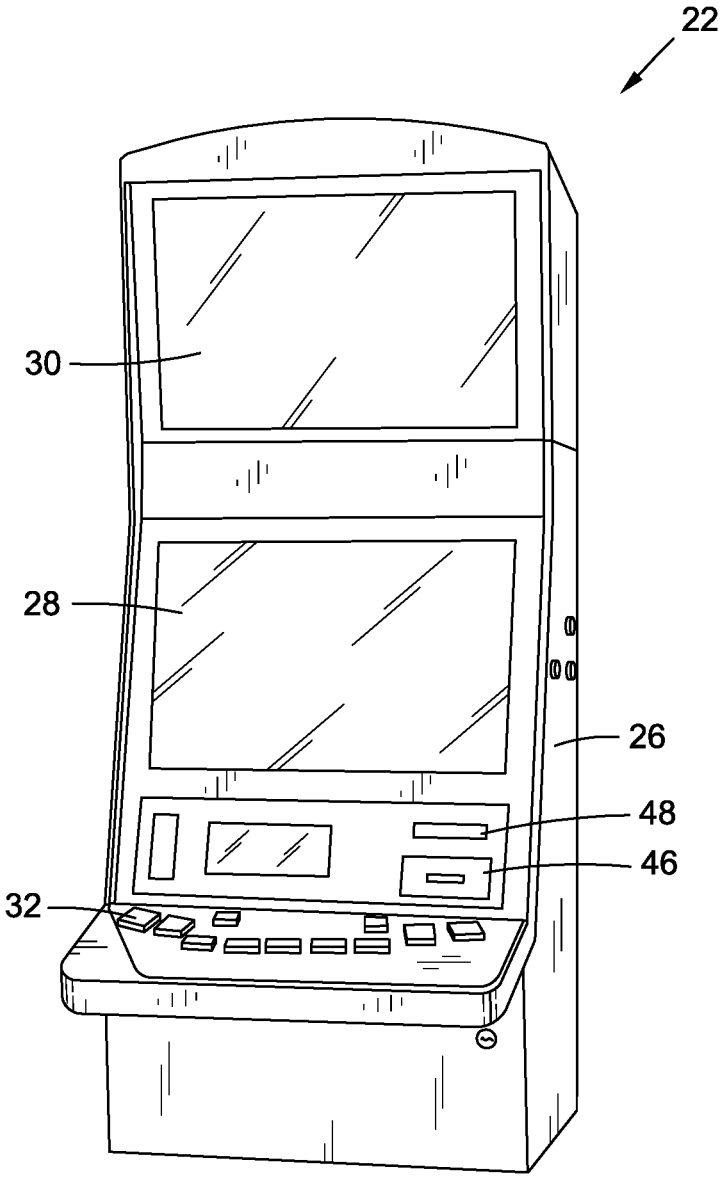
FIG. 3 is a perspective view of a gaming machine in accordance with an exemplary embodiment.

One configuration of a gaming machine 22 is illustrated in FIG. 3. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one first display device 28 configured to display game information. The display device 28 may comprise an electronic video display such as a cathode ray tube (CRT), high resolution flat panel liquid crystal display (LCD), projection LCD, plasma display, field emission display, digital micromirror display (DMD), digital light processing display (DLP), LCD touchscreen, a light emitting display (LED) or other suitable displays now known or later developed, in a variety of resolutions, sizes and formats (e.g. 4:3, widescreen or the like). The display device 28 may be capable of projecting or displaying a wide variety of information, including images, symbols and other indicia or information associated with game play, game promotion or other events. The gaming machine 22 might include more than one display device, such as a main or first display device 28 and a secondary display device 30. The two or more display devices might be associated with the housing or, as illustrated in FIG. 3, the gaming machine 22 might also include a top box or other portion which includes the one or more second display devices 30. Also, the gaming machine 22 might include side displays (such as mounted to the exterior of the housing 26) and might include multiple displays of differing sizes.

As described in more detail below, the gaming machine 22 is preferably configured to present one or more games upon a player making a monetary payment or wager. In this regard, as described in more detail below, the gaming machine 22 includes mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 32 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, to cause the gaming machine 22 to initiate a game, to initiate a draw, to "cash out" of the gaming machine, or to provide various other inputs.

Referring to FIG. 3, in one preferred embodiment, the gaming machine 22 includes at least one microprocessor or controller 34 for controlling the gaming machine, including receiving player input and sending output signals for controlling the various components or peripheral devices of the machine 22 (such as generating game information for display by the display devices 28,30). The controller 34 may be arranged to receive information regarding funds provided by a player to the gaming machine 22, receive input such as a purchase/bet signal when a purchase/bet button is depressed, and receive other inputs from a player. The controller may be arranged to generate information regarding a game, such as generating game information for display by the at least one display device 28,30 (such as information comprising game cards, draws, wild space triggers, etc.), for determining winning or losing game outcomes and for displaying information regarding awards for winning game outcomes, among other things.

The controller 34 may be configured to execute machine readable code or "software" or otherwise process information, such as obtained from a remote server. Software 36 or other instructions may be stored at a memory or data storage device 40, e.g. in a fixed or non-transitory configuration. The memory may also store other information or data 40, such as data stored in table or other forms (including, but not limited to look-up tables, pay tables and other information including tracked game play information). The gaming machine 22 may also include one or more random number generators for generating random numbers (such as implemented by a random number generator software module stored in the memory 40 and executable by the processor 34), such as for use in creating game cards and conducting a draw order, and for presenting the game in a random fashion (e.g. whereby the game is presented in a manner in which the player cannot control the outcome) or pseudo-random fashion (e.g. such as where the game includes a skill component which can affect the outcome of the game).

Preferably, the controller 34 is configured to execute machine readable code or instructions (e.g. software) which are configured to implement the game. In this regard, the gaming machine 22 is specially configured to present the game of the invention via specific software and/or hardware which causes the gaming machine to operate uniquely. For example, the controller 34 of the gaming machine 22 may be configured to detect a wager, such as a signal from a player's depressing of the "bet one" button. Upon such an event and/or the player otherwise signaling the gaming machine to present the game, the controller may be configured to cause the at least one display 28 to display unique information, such as a unique graphical interface or unique game display, including game symbols or other game information. The controller may accept input from a player of game inputs, such as a request to spin reels or the like, via the one or more player input devices of the gaming machine 22. As indicated above, the machine readable code may be configured in various manners, such as by having various "modules" of software which are designed to implement specific features of the game play or game presentation.

The gaming machine 22 may be configured to generate and present games in a stand-alone manner or it may be in communication with one or more external devices or systems 42 at one or more times. The gaming machine 22 might communicate with one or more of such external devices or systems 42 via one or more communication ports 44 or other interface devices. These ports or interface devices 44 may be configured to implement various communication protocols (including proprietary protocols) and communicate via wireless, wired or other communication link. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

Figure 4:
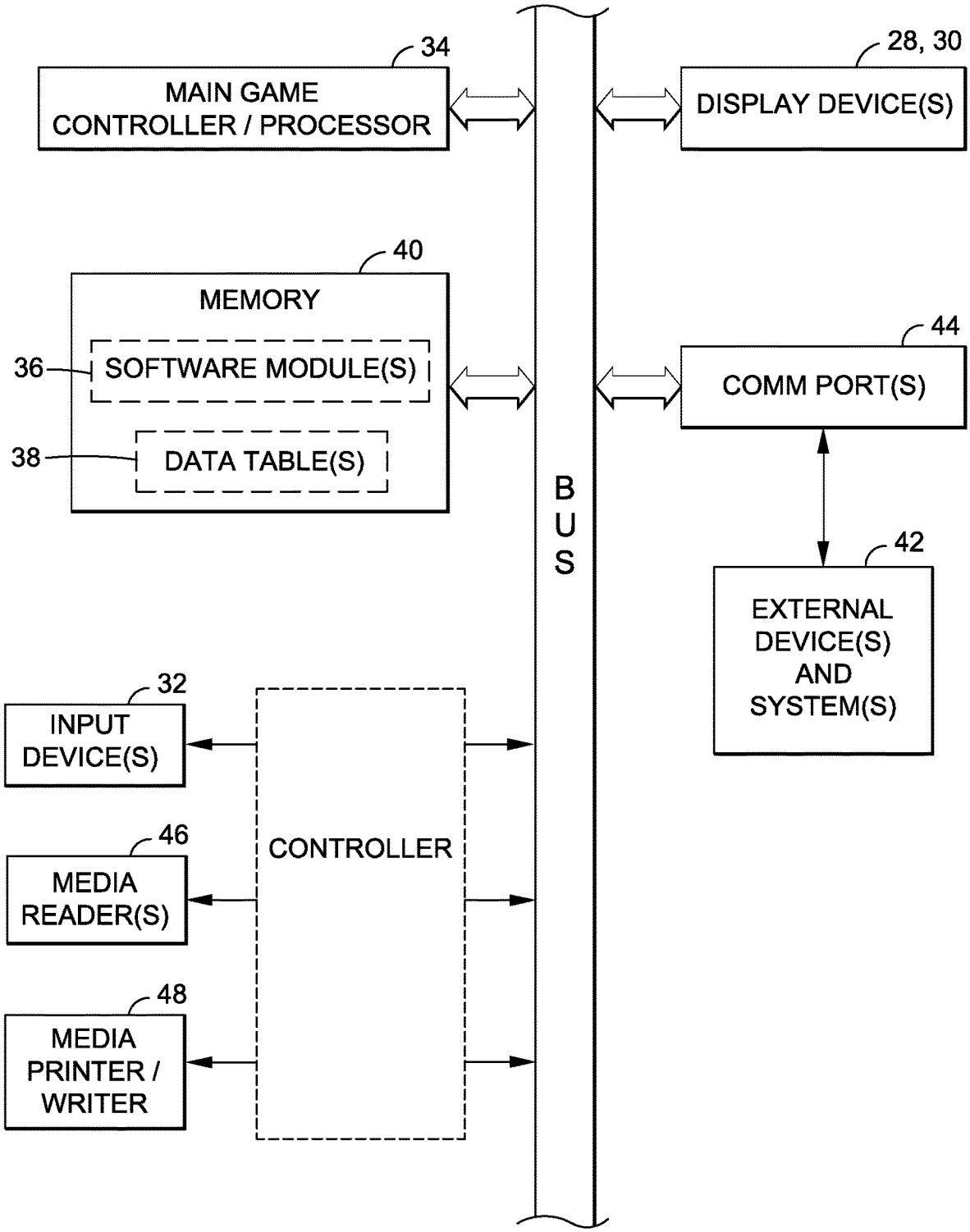
FIG. 4 diagrammatically illustrates a configuration of the gaming machine illustrated in FIG. 3.

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, the gaming machine 22 might include a coin acceptor for accepting coins. Of course, associated coin reading/verifying devices and coin storage devices may be associated with the gaming machine 22 if it is configured to accept coins. Likewise, as illustrated in FIGS. 3 and 4, the gaming machine 22 might include a media reader 46. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications, such as to enable the transfer of funds from the player to the gaming machine or system.

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In this regard, the gaming machine 22 may include one or more media printers or writers 48. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and/or an associated keypad or other input device (such as a touch screen display). Such player tracking devices are well known and may permit the game operator to track play of players of the gaming machine. The tracked play may be utilized to offer player bonuses or awards.

As illustrated in FIG. 4, the main game controller or processor 34 may communicate with several of the peripheral devices via one or more intermediary controllers. For example, some of the peripheral devices might comprise USB type or enabled devices which are controlled by an intermediary USB controller.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIGS. 3 and 4 is only exemplary of one embodiment of a gaming machine. For example, it is possible to for the gaming machine to have various other configurations, including different shapes and styles and having different components than as just described.

For example, instead of comprising a "casino"-style gaming machine, it is possible for the game of the invention to be presented on a computing device, including at a home or office computer or a player's mobile electronic device such as a PDA, phone or the like. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays. For example, relative to the Latin Bingo type game disclosed herein, a remote server may be configured to generate game cards and game card series as well as draw balls or numbers which are matched against those cards. The game card information and ball/number draw information may be transmitted to the gaming machine which uses that information to display the game to the player.

The gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

One embodiment of the invention is a gaming machine and methods of playing and presenting games with accumulating multiplier functionality.

Figure 5:
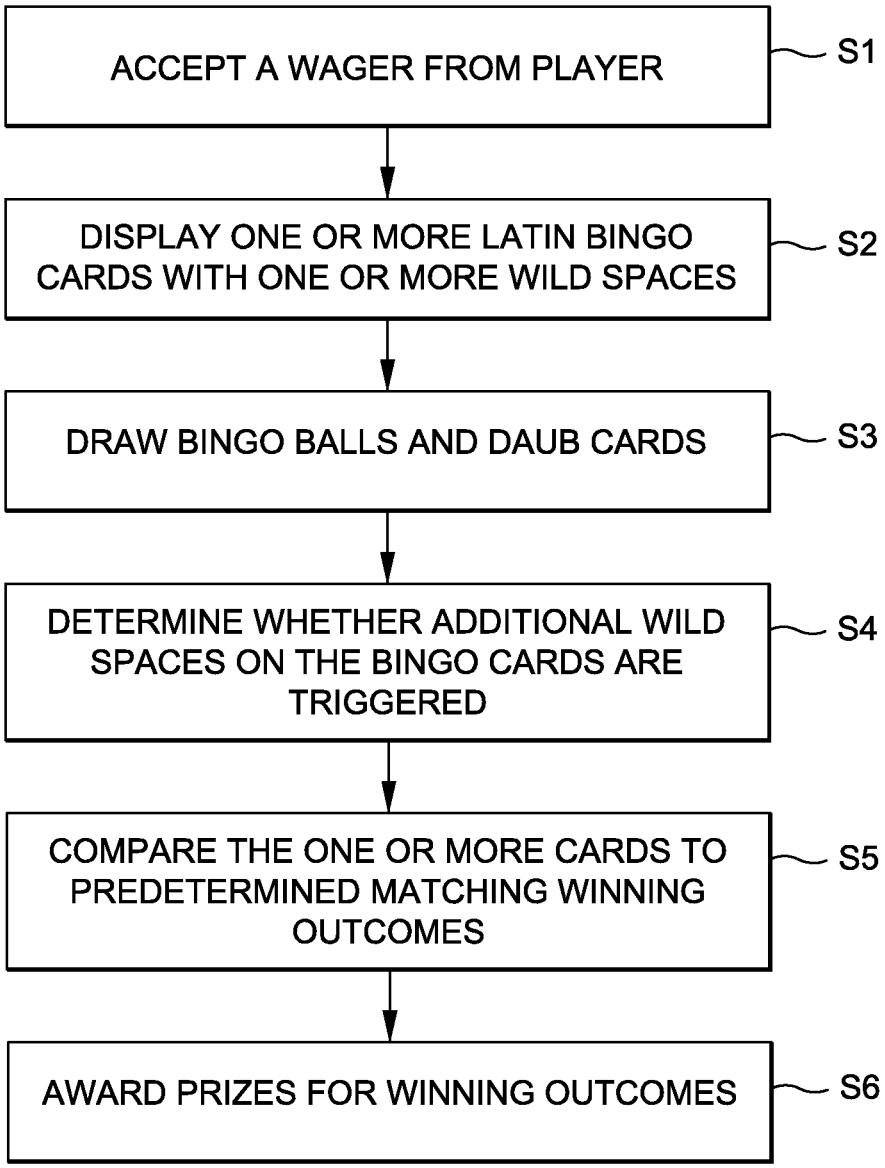
FIG. 5 is a flow diagram of a method of presenting a Latin bingo game according to one exemplary embodiment.

One embodiment of a gaming machine and a method of playing and presenting a game, such as a Latin Bingo type game in accordance with an embodiment of the invention will be described with reference to FIG. 5. In one embodiment, the game is presented as a wagering game. As such, in a step S1, a wager is accepted from a player. As indicated above, this may comprise a player providing monetary value to the gaming machine in order to associate value with the gaming machine. This value may be represented by one or more credits. In one embodiment, the step of accepting a wager may comprise the player providing a wager input to the gaming machine, such as an input to a "bet one" or "bet max" button, by depressing a draw button or the like. As also noted above, when the player places their wager, the credit balance associated with the gaming machine is preferably decreased by the amount wagered.

In a step S2, a player selects one or more Latin Bingo cards (in one embodiment, the selection may simply comprise an election to play the game, such as by placing a wager and then having the game card(s) be randomly assigned to the player). Most importantly, unlike traditional Latin Bingo cards where the cards each display a 3×5 grid of fifteen numbers, the cards in this embodiment incorporate at least one free or wild space (e.g. a space which is considered to be automatically marked or matched relative to winning game patterns, without the requirement that the space be matched to a called game number or ball). In one exemplary embodiment, the cards display a 3×5 grid containing only nine numbers and an additional six free spaces. In this embodiment, a series of cards (enough cards to display all numbers 1-90) includes displaying ten cards with nine numbers on each card and six free spaces on each card. The game cards might be generated by the gaming machine or a remote game server or the like.

An example of a series of ten cards is shown in FIG. 6. In this embodiment, the six free spaces in each card form a predetermined pattern. That is, on the top and bottom row of each card, the free spaces are placed at the second and fourth positions on the row. In the middle row, the free spaces are placed at the first and fifth position. Of course, other positioning of the free spaces may be used. By incorporating free spaces, such as the six free spaces shown, in every card and thereby increasing the number of cards in a series, such as to ten, the player experiences a more exciting game. With each ball drawn, a hit or mark is achieved. Further, the probability of achieving a winning pattern due to the free spaces and the multiple cards increases. The experience of more marks and increased probability creates a game with more player excitement and prize frequency.

Returning to FIG. 5, once the bingo cards with the free spaces are generated, the bingo balls are drawn or called and the cards are daubed as shown in step S3. While representations of bingo balls which display game numbers may be displayed graphically to a player, the selected or called game numbers may be called or displayed in other manners. In one embodiment, this process may be initiated by the player via the input device. The gaming machine may automatically randomly generate the called balls/numbers and daub the cards (or as indicated above, a game server might generate and provide that information to the gaming machine for use by the gaming machine in displaying the game). In other embodiments, the player may daub the cards via the player input device. It is noted that the number of called numbers or balls can vary and the numbers or balls can be called in one or more sets, including where a player may be required to place a secondary wager in order to play one or more additional sets. For example, relative to a series of card which includes all 90 game numbers, a subset of 30 balls might be called or drawn for matching to the game cards.

Figure 7:
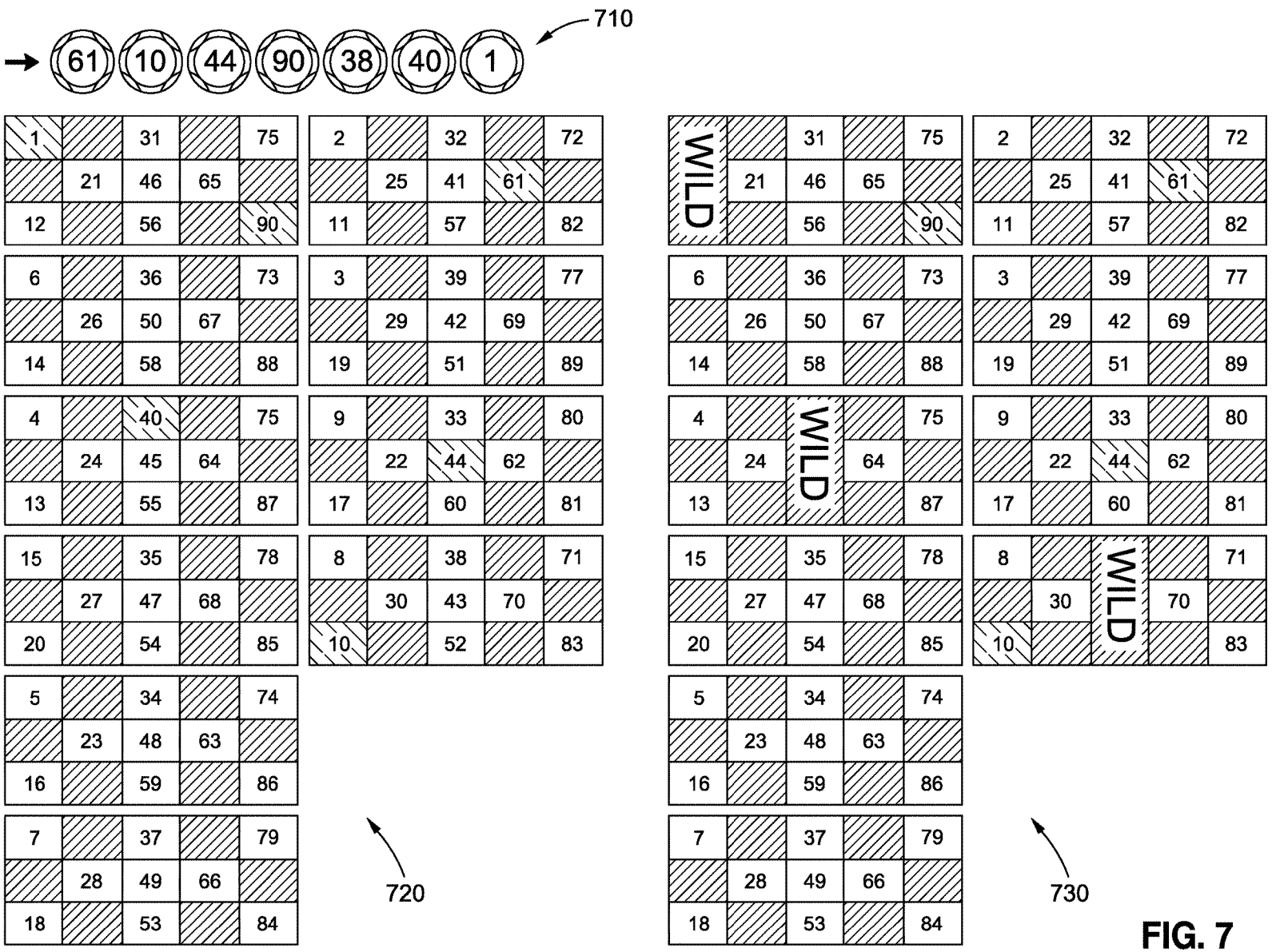
FIG. 7 is an example of additional wild spaces for a series of Latin bingo cards, according to one embodiment.

In step S4, it may optionally be determined whether additional multiple wild spaces are triggered. In one embodiment, an entire column on a bingo card may be determined to be Wild when certain conditions are met. For example, as shown in FIG. 7, a series of balls 710 are drawn, and the last three balls are numbers 38, 40, and 1. The gaming machine may determine that when the last three balls drawn correspond to a number on the top row of one of the gaming cards, the column corresponding to that number is made wild. In FIG. 7, the series of cards 720 is shown with the series of balls drawn 710 highlighted. It can be seen in this example that numbers 38, 40, and 1 correspond to positions on the top row of three of the cards. Accordingly, the series of cards 720 is transformed to the series 730 where the columns (e.g. all spaces in a column) corresponding to those positions are made Wild.

The conversion of certain card positions to Wild based upon certain matching criteria s allows the mathematical algorithm of the game to generate more winning patterns increasing the frequency of game wins, creating a better player experience. A variety of conditions may be established to determine which positions are changed to Wild positions. For example, when the first three balls and the last three balls drawn match a number on the top row of one of the cards, the column of that number may be changed to a Wild. In another embodiment, when one of the first three or last three balls drawn matches a number in the center column of a card, the row may be changed to a Wild. Any other number of variations to designate balls or positions to determine which spaces are changed to wild may be utilized, although the configuration as described above has been determined to be particularly advantageous, both because the numbers on the top row are easy to see/identify by the player and because using only the first and last 3 called balls/numbers relative to the number of top row positions and converting those columns to Wild advantageously benefits the RTP to the player without disadvantaging the house. It is noted that this feature of the invention described in this step S4 could be applied to Latin Bingo games where the cards do not include base free or wild spaces, but the combination of this feature with cards including those free or wild spaces is particularly advantageous in generating a positive RTP.

Figure 2:
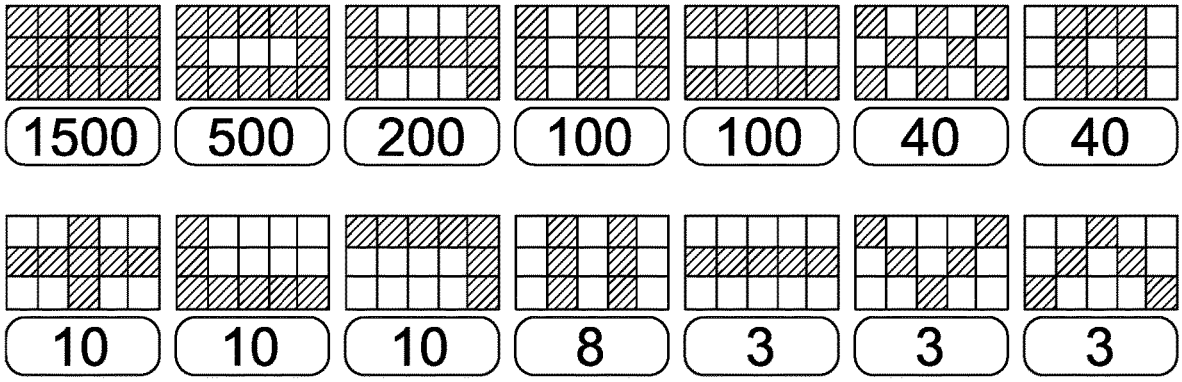
FIG. 2 shows exemplary winning patterns of a Latin bingo game.

Returning to FIG. 5, in step S5, the one or more bingo cards are compared to predetermined matching winning outcomes. For example, the winning outcomes shown in FIG. 2 may be utilized. Then, in step S6, the player is awarded prizes when the pattern of matched or marked card positions (including the free or Wild spaces) on one or more the cards matches one or more of the predetermined matching winning outcomes or patterns. The prizes may be awarded as credits at the gaming machine, for example. The prizes may be dependent on which one of the outcomes is achieved, as shown in the example in FIG. 2.

In some embodiments, when the player has not achieved a matching pattern, but is close to a matching pattern or has triggered another condition, the player may be allowed to purchase one or more additional balls/numbers in order to try and achieve the winning outcome. The price of the additional balls/numbers may be varied based on the quantity of additional balls/numbers purchased by the player, or other factors.

Figure 8:
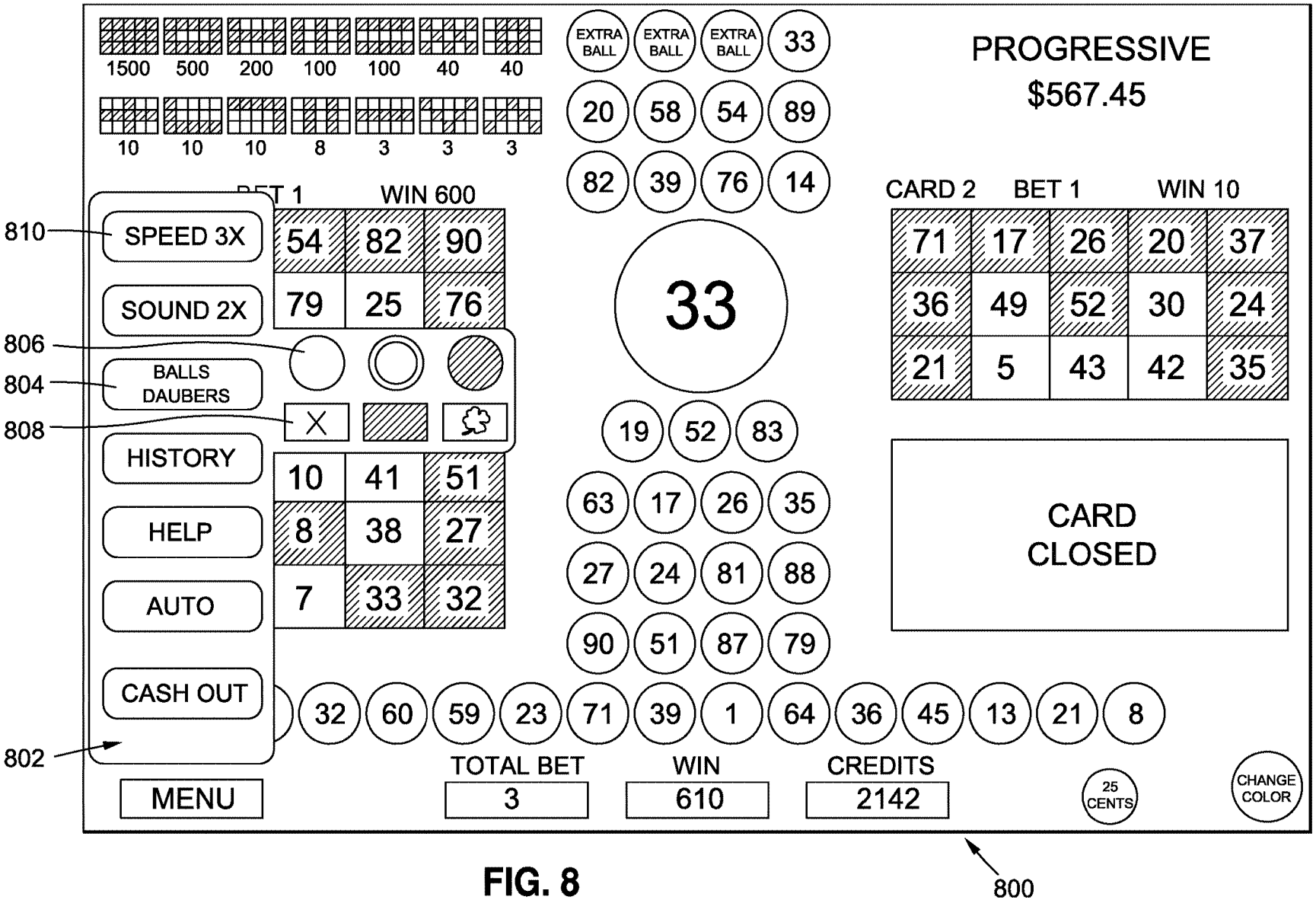
FIG. 8 is an exemplary arrangement of customizable screen elements, according to one embodiment.

In some embodiments of the invention the game program provides the player the ability to customize the player experience in a video implementation of Latin Bingo where game information is presented or displayed by one or more graphical user interfaces or other graphically displayed information or elements. For example, as illustrated in FIG. 8, the player may select a personalized set of balls, background screens, and/or daubers and markers. The personalizations may include changes in themes, colors, graphics, sound effects, or the like. In another embodiment, the player may also personalize a game speed to control the speed of the draw and the card marking. These features further enhance the enjoyment of the game.

For example, as shown in FIG. 8, the display 800 of a gaming machine may present a menu 802 with a number of customization options. The menu 802 may be displayed in response to a user input, such as via an icon displayed on a touchscreen. The menu 802 provides the user with options for customizing the look and feel of the game being played.

As a first example, the user may use a display changing option 804 on the menu 802 to change the look of the balls or daubers used in the game. In FIG. 8, when the user selects the screen customization icon 804, the user is presented with options 806 for different designs of balls or daubers to use. In this embodiment, there are three different designs. However, there may be more or less designs than shown. Further, the user may be able to add further customization of the balls in addition to the options shown, such as by choosing a custom color for the balls.

The user may also use the display changing option 804 to select one of a variety of background options 808. When the user selects one of the background options 808, the color and/or theme of the game may change according to the user's preference. In this example, there are three options for the user to select. However, there may also be more or less options for the user. Further, the user may select a custom color for the background in some embodiments.

Another example customization shown in FIG. 8 that is displayed in the menu 802 is a speed customization 810. By selecting this option, the player can speed up or slow down the rate of the game play. For example, when the user selects a faster speed, the game animates the balls being drawn and the positions being marked or drawn at a higher rate of speed, such that there is less time between plays of the game. On the other hand, when the player selects a slower speed, the player can more easily track the dynamics of the game as the game animates more slowly.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a monetary funds accepting mechanism for accepting monetary funds to add to a player credit balance;

at least one display device;

at least one player input device;

a memory device;

a controller; and machine-readable code stored in said memory device executable by said controller to, in response to a wager placed by said player from said player credit balance, cause said gaming machine to:

display, via said at least one display device, one or more Latin bingo cards, each of the one or more Latin bingo cards comprising a three row by five column bingo card defining 15 spaces with at least one free space and game numbers displayed relative to the remaining spaces;

draw bingo balls and daub corresponding numbers on the one or more Latin bingo cards;

evaluate said one or more Latin bingo cards to said drawn bingo balls to determine a wild space condition comprising a first three or a last three of the drawn bingo balls matching a game number in a top row of the one or more Latin bingo cards;

when said wild space condition exists, graphically transform said one or more Latin bingo cards displayed via said at least one display device to display wild spaces in the spaces of a column of the one or more Latin bingo cards corresponding to the matching number in the top row of the one or more Latin bingo cards, the wild spaces displayed in replacement of the game numbers that were displayed in those spaces;

compare in real time the daubed numbers, the free spaces, and the wild spaces of the one or more Latin bingo cards to predetermined matching winning outcomes; and award an award to said player when the one or more Latin bingo cards matches the predetermined matching winning outcomes, said award being credits to said player credit balance.

2. The gaming machine according to claim 1, wherein each of the one or more Latin bingo cards comprises six free spaces.

3. The gaming machine according to claim 2, wherein the six free spaces are distributed with two of the six free spaces in each row.

4. The gaming machine according to claim 3, wherein the two free spaces in a first row and a third row are placed in a second and a fourth column, and the two free spaces in a second row are placed in a first and a fifth column.

5. The gaming machine according to claim 2, wherein the one or more Latin bingo cards comprises a series of cards, the series of cards comprising ten Latin bingo cards with the six free spaces.

6. The gaming machine according to claim 1, wherein information displayed via said at least display device of the gaming machine is customized for at least one of a background screen color, dauber color, and game speed.

7. A method of presenting a game at a gaming machine comprising the steps of:

receiving a physical item associated with a monetary value at a wager accepting device of the electronic gaming device to increase a credit balance stored on the electronic gaming device;

receiving a wager on a base game via an input device of the electronic gaming device;

initiating the base game via one or more processors;

displaying, via at least one display device, one or more Latin bingo cards, each of the one or more Latin bingo cards comprising a three row by five column bingo card defining 15 spaces with at least one free space and game numbers displayed relative to the remaining spaces;

drawing bingo balls and daubing corresponding numbers on the one or more Latin bingo cards;

evaluating, via said one or more processors, said one or more Latin bingo cards to said drawn bingo balls to determine a wild space condition comprising a first three or a last three of the drawn bingo balls matching a game number in a top row of the one or more Latin bingo cards;

when said wild space condition exists, graphically transforming said one or more Latin bingo cards displayed via said at least one display device to display wild spaces in the spaces of a column of the one or more Latin bingo cards corresponding to the matching number in the top row of the one or more Latin bingo cards, the wild spaces displayed in replacement of the game numbers that were displayed in those spaces;

comparing, via said one or more processors in real time, the daubed numbers, the free spaces and the wild spaces of the one or more Latin bingo cards to predetermined matching winning outcomes; and awarding an award to said player when the one or more Latin bingo cards matches the predetermined matching winning outcomes, said award being credits to said player credit balance.

8. The method according to claim 7, wherein each of the one or more Latin bingo cards comprises six free spaces.

9. The method according to claim 8, wherein the six free spaces are distributed with two of the six free spaces in each row.

10. The method according to claim 9, wherein the two free spaces in a first row and a third row are placed in a second and a fourth column, and the two free spaces in a second row are placed in a first and a fifth column.

11. The method according to claim 8, wherein the one or more Latin bingo cards comprises a series of cards, the series of cards comprising ten Latin bingo cards with the six free spaces.

12. The method according to claim 7, further comprising the step of customizing at least one of a background screen color displayed by said at least one display device, dauber color displayed by said at least one display device, and game speed.

13. A method of presenting a game at a gaming machine comprising the steps of:

receiving a physical item associated with a monetary value at a wager accepting device of the electronic gaming device to increase a credit balance stored on the electronic gaming device;

receiving a wager on a base game via an input device of the electronic gaming device;

initiating the base game via one or more processors;

displaying, via at least one display device, one or more Latin bingo cards, each of the one or more Latin bingo cards comprising a three row by five column bingo card with six free spaces where two free spaces of the six free spaces are distributed in each row with the two free spaces in a first row and a third row being placed in a second and a fourth column, and the two free spaces of a second row being placed in a first and a fifth column, and wherein game numbers are displayed relative to the remaining spaces;

drawing bingo balls and daubing corresponding numbers on the one or more Latin bingo cards;

evaluating, via said one or more processors, said one or more Latin bingo cards to said drawn bingo balls to determine a wild space condition comprising a first three or a last three of the drawn bingo balls matching a game number in a top row of the one or more Latin bingo cards;

when said wild space condition exists, graphically transforming said one or more Latin bingo cards displayed via said at least one display device to display wild spaces in the spaces of a column of the one or more Latin bingo cards corresponding to the matching number in the top row of the one or more Latin bingo cards, the wild spaces displayed in replacement of the game numbers that were displayed in those spaces;

comparing, via said one or more processors in real time, the daubed numbers, the free spaces and the wild spaces of the one or more Latin bingo cards to predetermined matching winning outcomes; and awarding an award to said player when the one or more Latin bingo cards matches the predetermined matching winning outcomes, said award being credits to said player credit balance.

* * * * *